US006132584A

United States Patent [19]

Hubel

[11] Patent Number: 6,132,584

[45] Date of Patent: Oct. 17, 2000

[54] PROCESS AND CIRCUITRY FOR GENERATING CURRENT PULSES FOR ELECTROLYTIC METAL DEPOSITION

[75] Inventor: Egon Hubel, Feucht, Germany

[73] Assignee: Atotech Deutschland GmbH, Germany

[21] Appl. No.: 09/091,136

[22] PCT Filed: Sep. 27, 1996

[86] PCT No.: PCT/EP96/04232

§ 371 Date: Jun. 4, 1998

§ 102(e) Date: Jun. 4, 1998

[87] PCT Pub. No.: WO97/23665

PCT Pub. Date: Jul. 3, 1997

[30] Foreign Application Priority Data

Dec. 21, 1995 [DE] Germany ..... 195 47 948

[51] Int. Cl.[7] ..... C25D 5/18

[52] U.S. Cl. ..... 205/103; 204/230.6; 204/230.8; 205/104

[58] Field of Search ..... 205/103, 104, 205/105, 107, 108; 204/229.3, 230.6, 230.8

[56] References Cited

U.S. PATENT DOCUMENTS

| | | | |
|---|---|---|---|
| 3,616,434 | 4/1968 | Hausner | 204/229.5 |
| 3,959,088 | 5/1976 | Sullivan | 205/104 |
| 4,208,254 | 6/1980 | Mitsumoto et al. | 205/101 |
| 4,517,059 | 5/1985 | Loch et al. | 205/83 |

FOREIGN PATENT DOCUMENTS

| | | |
|---|---|---|
| 27 39 427 | 3/1978 | Germany . |
| 40 05 346 | 8/1991 | Germany . |
| 2214520 | 1/1989 | United Kingdom . |

*Primary Examiner*—Kathryn Gorgos
*Assistant Examiner*—Willaim T. Leaden
*Attorney, Agent, or Firm*—Paul & Paul

[57] ABSTRACT

The invention relates to a method of generating short, cyclically repeating, unipolar or bipolar pulse currents $I_G$, $I_E$ for electroplating, and to a circuit arrangement for electroplating with which pulse currents $I_G$, $I_E$ can be generated. Electroplating methods of this type are referred to as pulse-plating methods. According to the invention, the secondary winding 6 of a current transformer 1 is connected in series into the electroplating direct current circuit 5, consisting of a bath direct current source 2 and a bath which is contained in an electroplating cell and which is represented by resistor $R_B$. The primary winding 7 of the transformer has a larger number of turns than the secondary winding. The primary winding is controlled with pulses of high voltage and with relatively low current. The high pulse current on the secondary side temporarily compensates in pulses the electroplating direct current. This compensation can be a multiple of the electroplating current, such that deplating pulses with high amplitude are produced. The capacitor 10 guides the compensating current through charging and discharging. Through the invention, the necessity of using in pulse-plating the known electronic high current switches, which work uneconomically because of the great current conduction losses, is avoided.

10 Claims, 7 Drawing Sheets

PROCESS AND CIRCUITRY FOR GENERATING CURRENT PULSES FOR ELECTROLYTIC METAL DEPOSITION

SPECIFICATION

The invention relates to a method for generating short, cyclically repeating, current pulses with great current intensity and with great edge steepness. In addition, it relates to a circuit arrangement for electrolytic metal deposition, especially for carrying out this method. The method finds application in electrolytic metal deposition, preferably in the vertical or horizontal electroplating of printed circuit boards. This type of electroplating is referred to as pulse-plating.

It is known that the electrolytic deposition of metals can be influenced with the aid of pulse-like currents. This affects the chemical and physical properties of the layers deposited. It also affects, however, the even deposition of the layer thickness of the metals on the surface of the workpiece to be treated, the so-called dispersion. The following parameters of the pulsating electroplating current influence these qualities:

Pulse frequency

Pulse times

Pause times

Pulse amplitude

Pulse rise time

Pulse fall time

Pulse polarity (electroplating, deplating).

In publication DE 27 39 427 A1, electroplating with a pulsating bath current is described. The unipolar pulses here have a width of 0.1 millisecond maximum. The pulse time, the pause time and the pulse amplitude are all variable. Semiconductor switches, here in the form of transistors, serve to generate these pulses. What is disadvantageous about this is that, through the use of switching transistors, the maximum applicable pulsating bath current is technically and economically limited. The upper limit lies at approximately 100 amperes.

The process described in the publication DE 40 05 346 A1 avoids this disadvantage. Here thyristors which can be switched off are used as quick switching elements (GTO: Gate turn-off thyristor) to generate the current pulses. Technically available GTOs are suitable for currents of up to 1,000 amperes and more.

In both cases, the technical outlay has to be reflected, i.e. to be doubled, if bipolar pulses are used. In publication GB-A 2 214 520, which is likewise concerned with pulse plating, a second bath current source is avoided in one form of embodiment by using mechanical, electromechanical or semi-conductor switches to reverse the polarity of the direct current voltage fed in. The necessary high current switches are disadvantageous however. Moreover this system is inflexible since the method must proceed in both polarities with the same current amplitude, for, with short high current pulses, the amplitude cannot be readjusted quickly enough in the bath current sources which are available in practice. Thus, in a further form of embodiment in this publication, two bath current sources are also used which can be adjusted independently of one another. These bath current sources are connected via a change-over switch with the work-piece located in the electrolytic cell and the electrode. Since in printed circuit board electroplating, for reasons of the precision required (constancy of the layer thickness), it is necessary to use individually adjustable bath direct current sources for the front side of the printed board and the rear side of same, there is a doubling of the outlay which is necessary for realizing this method according to this form of embodiment, to four bath current sources altogether.

In addition to this high technical outlay, especially for the respective second bath current source per printed circuit board side, the electronic high current switches cause great energy losses. On each electronic switch, when it is switched on, a voltage drop occurs on the inner non-linear resistor when the current flows. This is true for all kinds of semiconductor elements in the same way, however with varying sizes of voltage drop. With increasing current, this drop in voltage, also called saturation voltage or forward voltage $U_F$, becomes greater. With the currents usually used in electroplating technology, e.g. at 1,000 amperes, the forward voltage $U_F$ on diodes and transistors amounts to approximately one volt and on thyristors approximately two volts. The power loss $P_V$ at each of these semi-conductor elements is calculated according to the formula $P_V=U_F \times I_G$, $I_G$ being the electroplating current. Where $I_G$=1,000A, the dissipated energy $P_V$ reaches 1,000 watt to 2,000 watt. The heat produced additionally by the electronic switches has to be carried away by cooling. In the actual bath current source, a power loss occurs likewise of at least the same magnitude, which is unavoidable. These losses are not to be included in the further considerations. Only the power losses which have to be additionally applied to pulse generation are taken into consideration.

An electroplating system consists of a plurality of electroplating cells. They are fed with large bath currents. As an example, a horizontal system for depositing copper on printed circuit boards from acid electrolytes will be looked at. The application of the pulse technology improves the amount of the copper deposition in the fine holes of the printed boards quite substantially. What has proved particularly effective is changing the polarity of the pulses in cycles. With cathodic polarity of the article to be treated, for example current pulses with ten milliseconds pulse width are used. This pulse can be followed by an anodic pulse with a width of one millisecond. In pulse-like cathodic electroplating, preferably a current density is chosen which is greater than, or the same as, the current density which is used with this electrolyte during direct current electroplating. During the short anodic current pulses, a deplating process with a substantially higher current density takes place than during the cathodic pulse phase. Advantageous here is approximately the factor 4 of the anodic to the cathodic pulse phase.

The printed boards are electroplated on both sides, i.e. on their front and their rear sides with separate bath current supplies. As an example five electrolytic baths of a horizontal electroplating system are looked at. They have per side, for example, five bath current supply units each with 1,000 amperes of nominal current, i.e. 10 bath current supply appliances with 10,000 amperes in total. The bath voltage for electroplating with acid copper electrolytes is from 1 to 3 volts and is dependent on the density of the current. Because of the high currents, the energy balance for the circuit proposed in the publication DE 40 05 346 A1 is looked at as an example (FIG. 7). A positive pulse generated with this circuit arrangement as an electroplating pulse with a width of t=10 milliseconds and a negative pulse as a deplating pulse with a considerably higher amplitude with a width of t=1 milliseconds, underlie the following consideration. Inaccuracies caused by low edge steepnesses are here disregarded. Thus for the span of 10 milliseconds, the semi-conductor elements 6, 9, 5 in the circuit arrangement shown in FIG. 7 carry the full electroplating current. The power loss of these switching elements amounts, per bath current supply with the forward voltages $U_F$ quoted above, to (2 volts+1 volt+2 volt)×1,000 amperes=5,000 watts. For the span of one millisecond, the semi-conductor elements 7 and 8, corresponding to the task set, then carry four times the current. This power loss amounts to $P_V$=(2 volts+2 volts)× 4,000 amperes=16,000 watts. The average high current switch power loss of a cycle lasting 11 milliseconds is thus approximately 6,000 watts. With ten bath current supplies this amounts to a power loss of 60 kW (kilowatts). To determine the degree of efficiency, this output must be compared with the output which is converted directly at the electrolytic bath for electroplating and for deplating. The bath voltages are, for this purpose, assumed to be for acid copper baths with 2 volts for electroplating and with 7 volts for deplating. Thus the average value of the overall bath output for pulse electroplating amounts to approximately 4.5 kW (for 10 milliseconds, 2 volts×1,000 amperes and for 1 millisecond, 7 volts×4,000 amperes). With the losses calculated above amounting to 6 kW, only the efficiency of the high current switches, related to the overall bath output, is clearly below 50%.

An electroplating system equipped with electronic high current switches in this way works completely uneconomically. Moreover the technical outlay for the electronic switches and their cooling is very high. The result of this is that pulse current appliances of this kind are also large in volume which works against placing them in spatial proximity to the electrolytic cell. This spatial proximity is however necessary in order to achieve the required edge steepness of the bath current in the cell at the electrodes. Long electrical conductors work with their parasitic inductances against any quick rise in current.

In comparison to the electronic switches, electromechanical switches have a much lower voltage fall when they are in the switched state. Switches or protection devices are, however, completely unsuitable for the required high pulse frequency of 100 Hertz. For the described technical reasons, the known method of pulsed electroplating is restricted to special applications and by preference to low pulse currents as far as electroplating is concerned.

Thus the problem underlying the present invention is to find a method and a circuit arrangement with which it is possible to generate short, cyclically repeating, unipolar or bipolar high currents for electroplating without the disadvantages mentioned occurring, especially without said currents being generated with a considerable power loss. Moreover, the necessary electronic circuit for this method should also be realized at a favorable price.

The purpose is fulfilled by the present invention.

The invention consists in the fact that there is coupled into an electroplating direct current circuit, called a high current circuit for short, comprising a bath direct current source, electrical conductors and an electrolytic cell with the electroplating article and anode in an inductive manner by means of a suitable component, for example a current transformer, a pulse current with such polarity that the bath direct current is compensated or over-compensated. The component is connected in series with the electrolytic electroplating cell. For example, to this end, the secondary winding of the current transformer with a low number of turns is connected to the bath direct current circuit in series in such a way that the bath direct current flows through it. In the primary winding, the current transformer has a high number of turns, such that the pulses feeding it in accordance with the turns ratio can have a low current with high voltage. The induced pulsed low secondary voltage drives the high compensation current. A capacitor, which is connected in parallel to the bath direct current source, serves to close the current circuit for the pulse compensation current.

BRIEF DESCRIPTION OF THE DRAWINGS

The invention is explained in detail with the aid of FIGS. 1–6. These show:

FIG. 2*a* is applicable during electroplating and FIG. 2*b* during deplating;

In the figures a bath current, indicated as positive, should apply for the electrolytic metallization, i.e. the article being treated is of negative polarity in relation to the anode. A bath current indicated as negative should apply for the electrolytic deplating. In this case, the article to be treated is of positive polarity in relation to the anode.

Figure 1A:
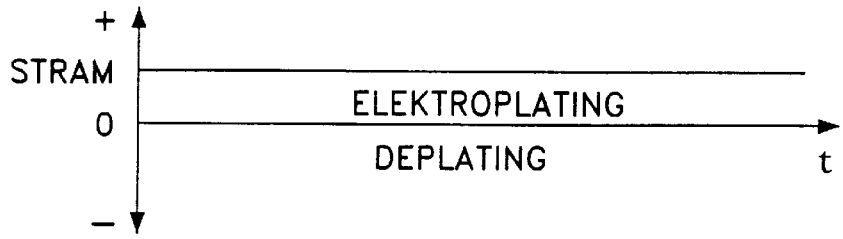
FIGS. 1*a*–1*e* unipolar and bipolar electroplating current paths, such as are usually used in practice.
Figure 1B:
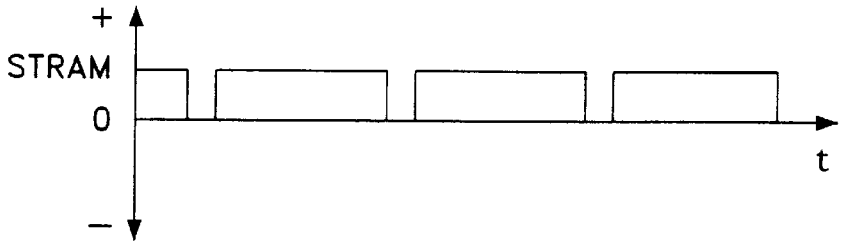
Figure 1C:
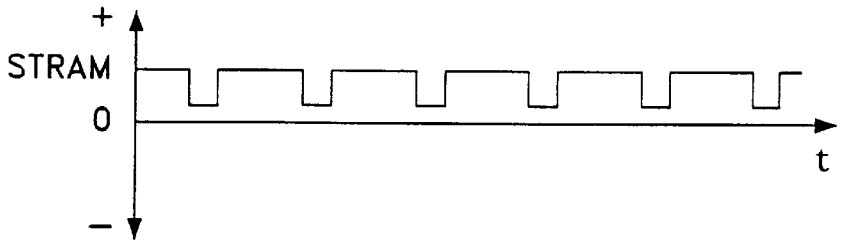
Figure 1D:
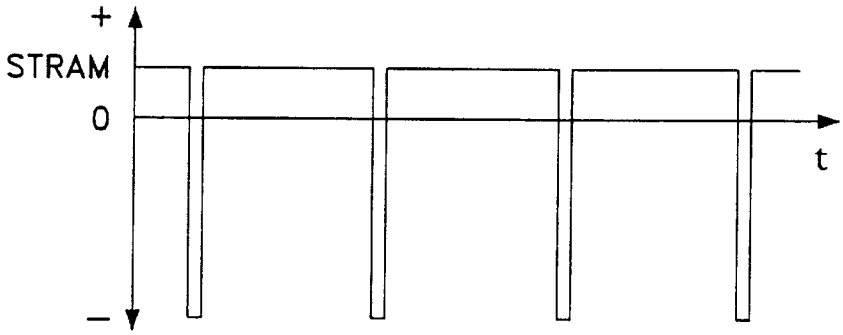
Figure 1E:
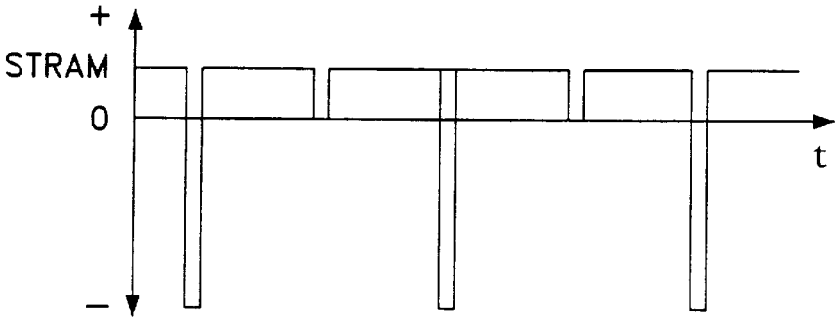

The diagram in FIG. 1*a* applies to electroplating with direct current. In FIG. 1*b* the bath current is interrupted for a short time. It remains, however, unipolar i.e. the polarity of the current direction is not reversed. The pulse times lie by preference in the order of magnitude of 0.1 milliseconds up to seconds. The pause times are correspondingly shorter. FIG. 1*c* shows a unipolar pulse current with different amplitudes. FIG. 1*d* shows a bipolar current, i.e. a pulse current which is briefly reversed in polarity with a long electroplating time and with a short deplating time. The deplating amplitude here amounts to a multiple of the metallizing amplitude. However, altogether, with an electroplating time of e.g. 10 milliseconds and with a deplating time of 1 millisecond, there is a clear excess of the amount of charge needed for electroplating as opposed to that needed for deplating. This pulse form is particularly suitable for electroplating on both sides printed circuit boards with fine holes. In FIG. 1*e*, a double pulse form is shown which can be achieved with the method according to the invention. Unipolar pulses here alternate with bipolar pulses.

The electroplating cell represents for the electroplating current an ohmic load as a good approximation. With a bath current supply according to FIG. 1*b*, bath current and bath voltage are therefore in phase. The low parasitic inductances of the electrical conductors to the electrolytic cell and back to the current source can be disregarded. Pulse currents contain on the other hand alternating currents. With increasing edge steepness of the pulses, the proportion of the high frequencies of the alternating currents becomes greater. Steep pulse edges have a short pulse rise and fall time. The line inductances represent inductive resistors for these alternating currents. They delay the pulse edges. However these effects are not considered below. They are independent of the type of pulse generation and therefore always the same if special measures are not taken. The simplest measures consist in using electrical lines with very low ohmic and inductive resistances. In the figures, in order to simplify the drawing, the electroplating current is always represented as, or assumed to be, in phase with the voltage.

Figure 2A:
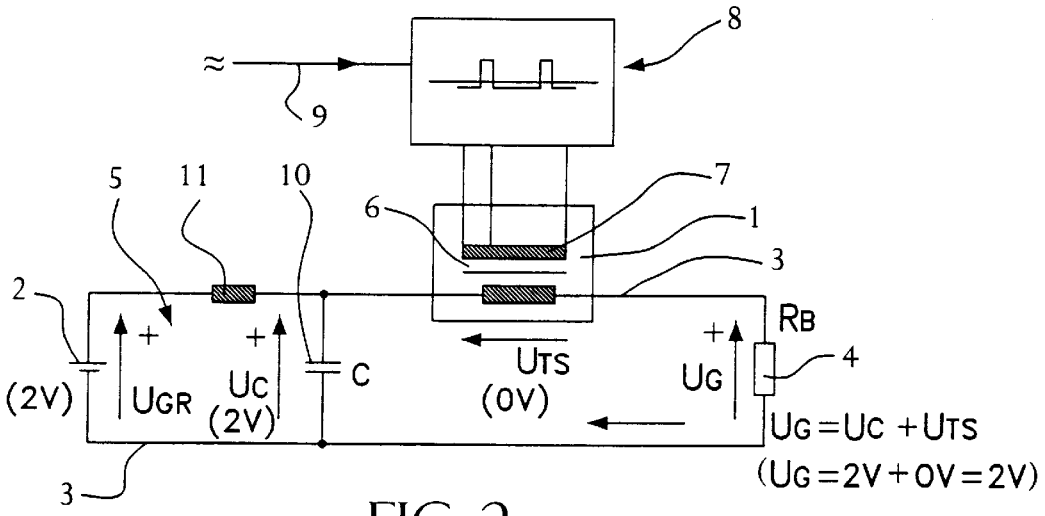
FIGS. 2*a* and 2*b* circuit arrangement for feeding the compensation current into the high current circuit.
Figure 2B:
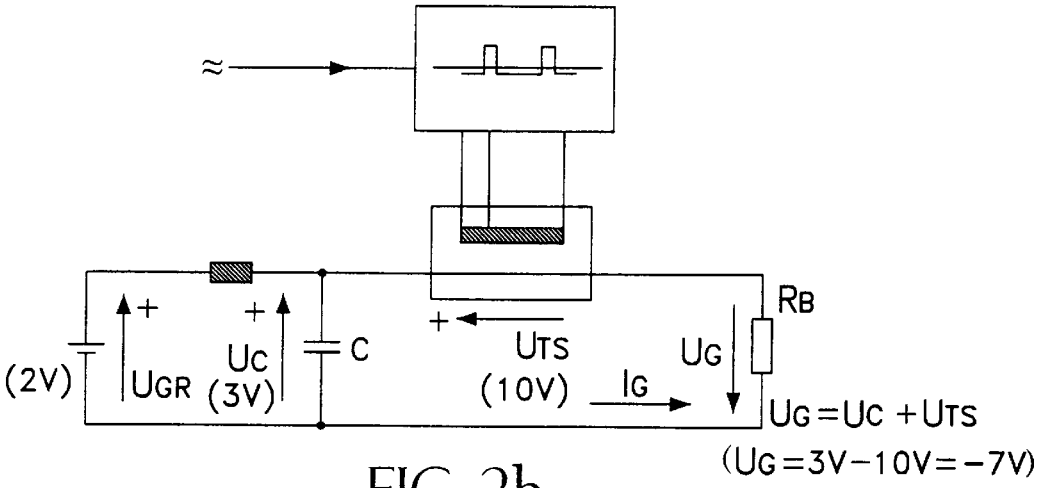

FIGS. 2*a* and 2*b* show the feeding in, according to the invention, of the compensating pulse current by means of the current transformer 1. The bath direct current source 2 is connected via electrical lines 3 with the electrolytic bath, which is here represented as the bath resistor $R_B$ with the reference number 4. The secondary winding 6 of the current transformer 1 is connected into this high current circuit 5 in series with the electrolytic bath. The primary side 7 of the transformer is fed by the pulse electronic unit 8. The pulse electronic unit 8 is supplied with energy via the main supply 9. The current and voltage paths for the pulses according to FIG. 1*d* correspond in principle also to the pulse forms of the other diagrams in FIG. 1. They differ only in the momentary size of the compensating current. For this reason the voltages or currents belonging to FIG. 1*d* are indicated in the following figures and considered.

FIG. 2*a* shows the state of operation during the electroplating. As an example, potentials are indicated in brackets. The capacitor C is charged to the voltage $U_C \approx U_{GR}$. The voltage $U_{TS}$ at the current transformer 1 amounts to 0 volts. Thus, apart from voltage drops at the line resistors and at the resistor of the secondary winding 6, the rectifier voltage $U_{GR}$ is present at the bath resistor $R_B$ and causes the electroplating current $I_G$. This temporary state corresponds to electroplating with direct current. In the high current circuit 5, no switches are needed according to the invention.

FIG. 2*b* shows the state of operation during deplating. The potentials can no longer be considered static. Therefore in FIG. 2*b*, the potentials for the end in time of the deplating pulse are shown in brackets. The starting point is provided by the potentials of FIG. 2*a*. The power pulse electronic unit 8 feeds the primary winding 7 of the current transformer 1 with a current which alters its amplitude in time. The current flow time corresponds to the time of the flow of the compensating current in the main current circuit 5. The primary voltage $U_{TP}$ at the transformer is such that, corresponding to the number of turns in the transformer winding a transformer pulse voltage $U_{TS}$ is achieved secondarily, which is in a position to drive the required compensating current $I_K$. Here, the capacitor C with the time constant $T=R_B \times C$, proceeding from the voltage $U_C \approx U_{GR}$, is further charged with the voltage $U_{TS}$. The charging current is the compensating current $I_K$ and at the same time the deplating current $I_E$. With a large capacity of the capacitor C, the rise in voltage in the short time of the charge current flow can be kept low. Instead of the capacitor C, an storage cell or storage battery can also be used in principle. The bath direct current source 2, consisting of a rectifier bridge circuit, switches itself off automatically for the period of the deplating, because through the charge, the voltage becomes $U_C > U_{GR}$. Without any additional switching elements being used, the direct current source 2, during the period of time in which the bath current $I_{GR}$ is fed by the induced voltage $U_{TS}$ into the current circuit, therefore feeds no current into the current circuit automatically. After the current compensation, the bath current is, however, supplied again from the direct current source. To avoid any short reverse flow in the switching-off moment with slow rectifier elements in the bath direct current source 2, a choke 11 can be inserted into the high current circuit 5. The energy for deplating is applied via the current transformer 1. The high, yet short in time, deplating current $I_E$ in the secondary winding 6 is fed in primarily. The current is reduced with the current transformer reduction ratio ü.

If this transformer has a reduction ratio of e.g. 100:1, for a compensating current $I_K$ of 4,000 amperes only approximately 4 ampere are to be fed in primarily. For the secondary voltage $U_{TS}$=10 volt in this example approximately 1,000 volts are necessary primarily. The power pulse electronic unit is thus to be dimensioned for high voltage and for relatively low pulse currents. Semi-conductor elements which are favourable in price are available for this. Thus, no high current switch is necessary even for the high deplating current in the main current circuit 5.

The power loss incurred for pulse generation is very low in comparison with known methods. The calculation of the dominating losses already shows the difference: in the power pulse electronic unit for generating pulse currents on the primary side, amongst other things consisting of an electronic switch with a forward voltage $U_F$=2 volts, the switch power loss amounts to P=40 amperes×2 volts× (approximately) 10% current flow time≈8 volts. In the same way, 8 watts are necessary for the reversed transformer current flow to the saturation of the transformer. With ten bath current supplies there is thus a power loss of approximately 160 watts altogether. For the comparison of the total switch losses of the circuit according to the invention with the losses of the known circuits, the current transformer losses must be included with the circuit according to the invention. If a very good coupling of the transformer is used, for example with a strip-wound cut toroidal core and with highly permeable thin metal sheets, a transformer efficiency of $\eta$=90% can be counted on. Thus these losses amount with a compensating current of 4,000 amperes and a voltage of 7 volts with approximately 10% current flow time to altogether approximately 560 watts. This produces for ten bath current supplies, according to the invention, a total power loss for generating the pulse electroplating current amounting to 160 watts for the switches and 5,600 watts for the current transformers. This sum includes approximately 6 kW for the dominating losses. In the example calculated above, according to the state of the art where 10 bath currents supplies were used, this amounted on the other hand to approximately 60 kW.

The technical outlay for carrying out the method according to the invention is likewise substantially lower than when traditional circuit arrangements are used. only passive components are loaded with the high electroplating currents and with the even higher deplating currents. This substantially increases the reliability of the pulse current supply equipment. Electroplating systems equipped in this way therefore have a clearly higher availability. This is achieved, moreover, with substantially lower investment outlay. At the same time, the continuing energy consumption is lower. On account of the lower technical outlay, the volume of pulse devices of this kind is small, with the result that it makes it easier to realise them in proximity to the bath. The line inductances of the main current circuit are therefore also reduced to a minimum.

Figure 3:
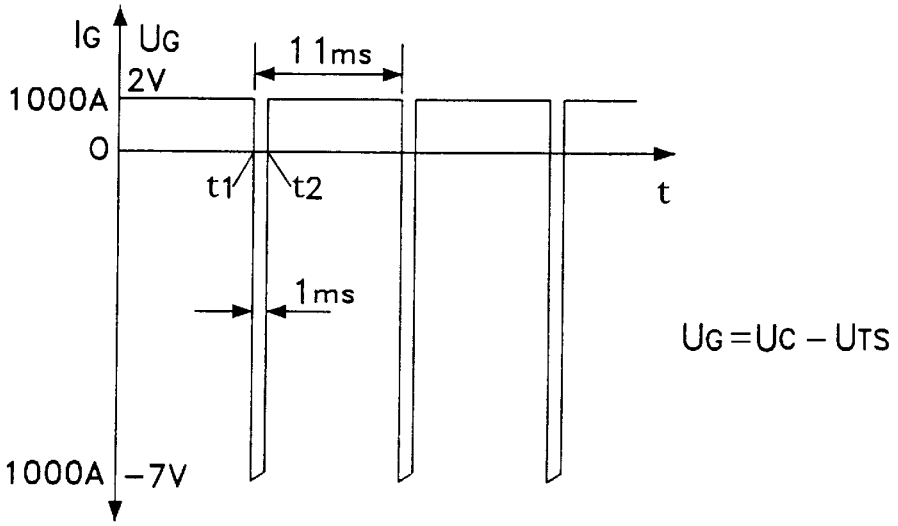
FIG. 3 a schematic representation of the current diagram for the bath current using the circuit arrangement shown in FIG. 2.

In FIG. 3 the path of the pulse current is represented diagrammatically at the bath resistor $R_B$ (electroplating cell 20). On account of the ohmic resistor $R_B$, the bath current and bath voltage are here in phase. At the point in time $t_1$, the flow of the compensating current begins. The size and direction are determined by the instantaneous voltages $U_C$ and $U_{TS}$. At the point of time $t_2$, the compensating current flow finishes. The following electroplating current $I_G$ is determined by the rectifier voltage $U_{GR}$, in each case in connection with the bath resistor $R_B$.

Figure 4A:
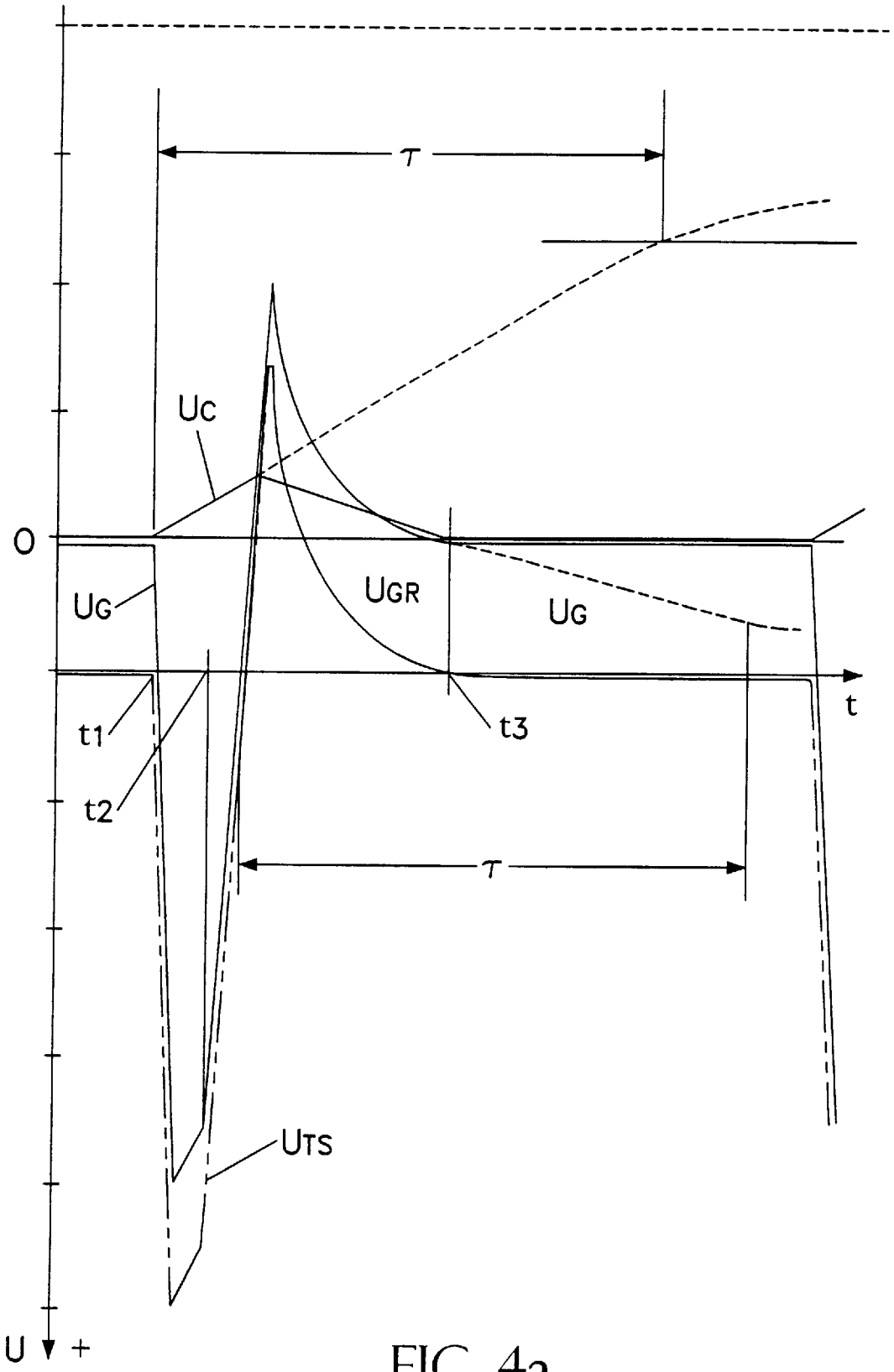
FIG. 4*a* voltage curves in the high current circuit, taking into account the rise and fall times.
Figure 4B:
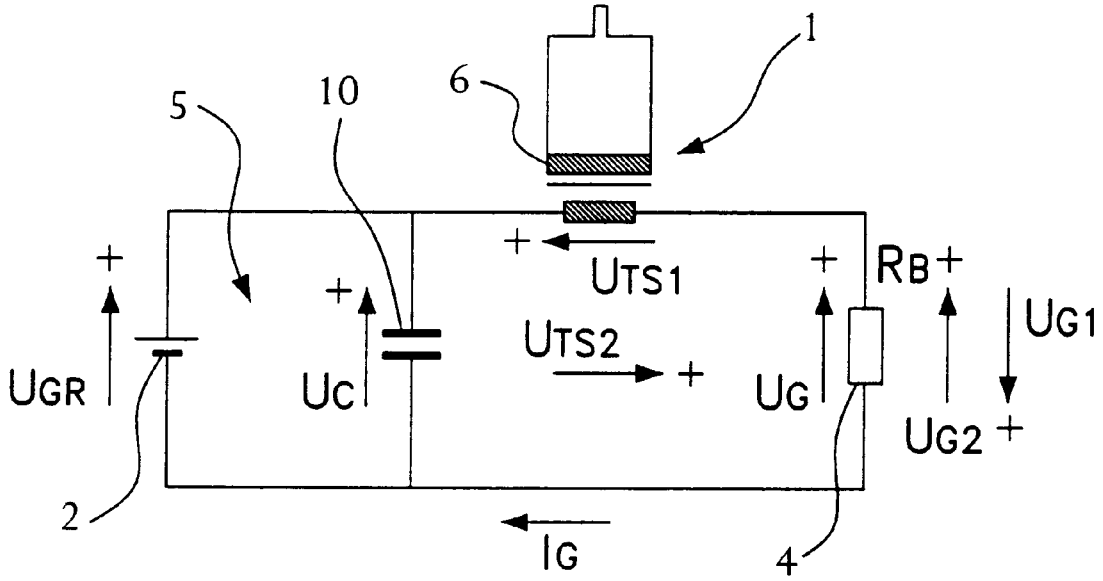
FIG. 4*b* an electrical wiring diagram with potentials entered.
Figure 5:
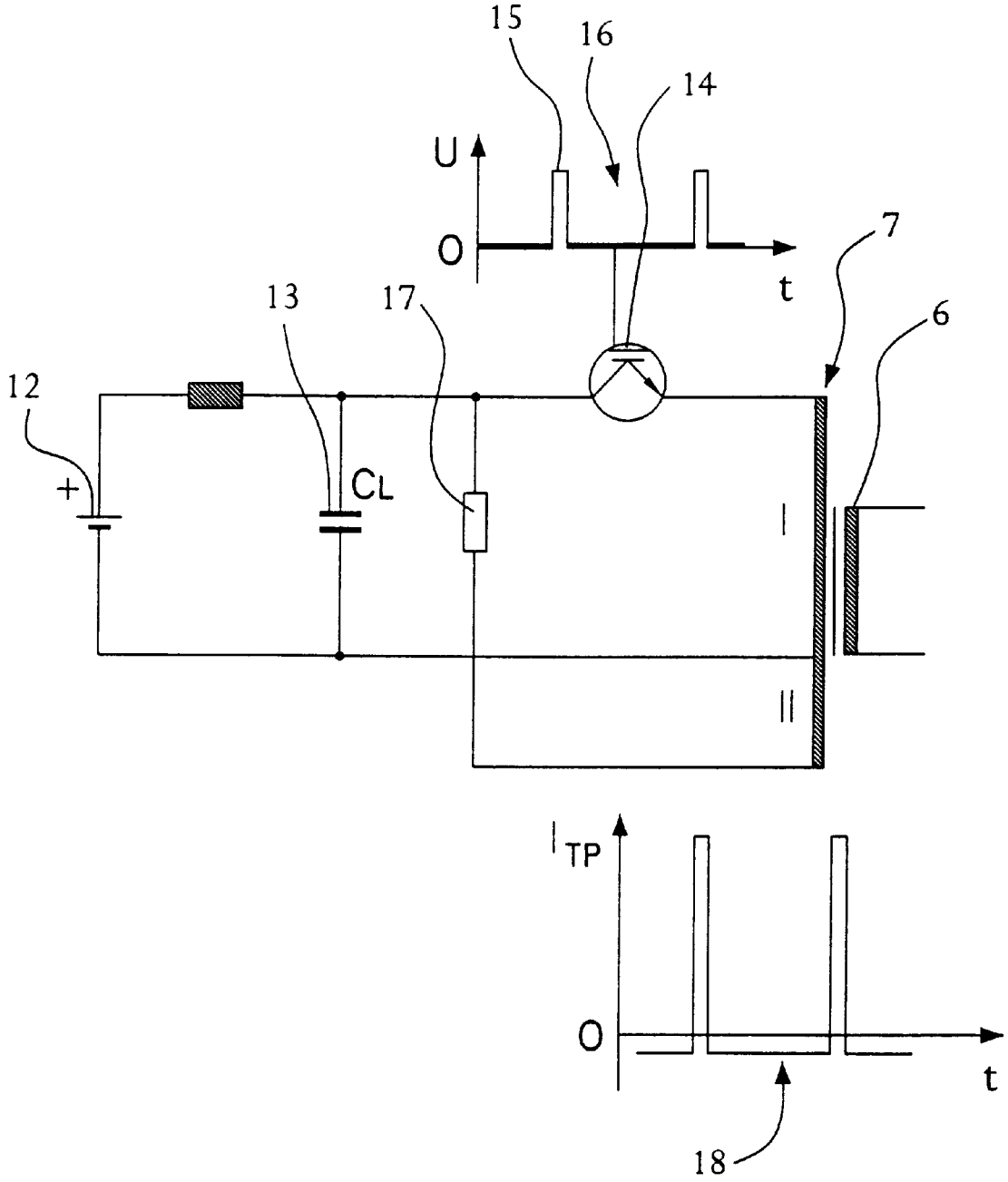
FIG. 5 a possible control circuit for the current transformer.

The time course of the voltages is represented more accurately in the diagrams of the FIGS. 4*a* and 4*b*. The electroplating current $I_G$ is practically in phase with the electroplating voltage $U_G$. $I_G$ is therefore not indicated because it has the same path. At the point of time t=0, the rectifier voltage $U_{GR}$, the capacitor voltage $U_C$ and, moreover, also the electroplating voltage $U_G$ are approximately the same. The voltage $U_{TS}$ amounts at this point in time to 0 volts. At the point in time $t_1$, the rise of the voltage pulse $U_{TS1}$ begins at the secondary winding 6 of the current transformer 1. The voltage $U_{TS1}$ is of such polarity that the electroplating voltage $U_{G1}$ becomes negative, with the result that it is possible to deplate. $U_G$ is formed from the sum of the instantaneous voltages $U_C$ and $U_{TS}$. The voltage $U_{TS}$ is poled at the capacitor C in the direction of the existing charge. The capacitor C therefore begins to charge itself again to the voltage $U_{TS}$ with the time constant $T=R_B \times C$. At the point of time $t_2$, the drop in the voltage pulse $U_{TS1}$ begins. Because of the final inductivity of the current transformer secondary circuit, the falling voltage pulse does not end at the zero line. Through voltage induction, a voltage $U_{TS2}$ with reverse polarity occurs. This is now added to the capacitor voltage $U_C$. At the bath resistor $R_B$, a brief excessive rise in voltage $U_{G2}$ occurs. The capacitor C begins to discharge itself with the time constants $T=R_B \times C$, it being at least partially or even completely discharged. At the time point $t_3$, the voltage $U_{TS}$ therefore amounts to 0 volts. The bath direct current source $U_{GR}$ takes over again the feeding of the bath resistor $R_B$, such that $U_G \approx U_{GR}$. The voltages $U_{GR}$, $U_C$ and $U_G$ are then approximately the same size again. The brief excessive rise of voltage at the bath resistor $R_B$ is undesired for electroplating purposes. In practice this peak and the additional peaks, differently from what is shown here, are clearly rounded. A recovery diode, parallel to the secondary winding or parallel to an additional winding on the core of the current transformer, effects if necessary a further weakening of the increase in voltage at the bath resistor $R_B$. On the other hand, the low excessive voltage then is present longer. There will be no further discussion of these systems of wiring inductances, nor likewise of the construction of the current transformer which is to be constructed as a pulse transformer. Pulses are to be fed on the primary side into the transformer in such a way that magnetic saturation of the transformer iron is avoided. For desaturation, there is after each current pulse sufficient time available in the pulse pauses to feed in a current with reverse polarity. To this end, an additional winding can be attached to the transformer core. FIG. 5 shows an example of the primary side triggering of the current transformer 1. An auxiliary source 12 is supported by a charging capacitor 13 with the capacity C. An electronic switch 14, here an IGBT (Isolated Gate Bipolar Transistor) is triggered by voltage pulses 15. In the switched state of the electronic switch 14, a primary current flows into the partial winding I of the primary winding 7 of the current transformer, and to simplify the circuit a desaturation current in the partial winding II. When the switch is not connected, only a desaturation current flows in the partial winding II. To reduce the outlay, a possible additional electronic switch for this current is dispensed with. The number of turns in the partial windings I and II as well as the protective resistor 17, via which a current of low magnitude flows permanently, are so adapted to one another that no saturation of the transformer iron occurs. The current diagram 18 in FIG. 5 shows diagrammatically the primary current $I_{TP}$.

Figure 6:
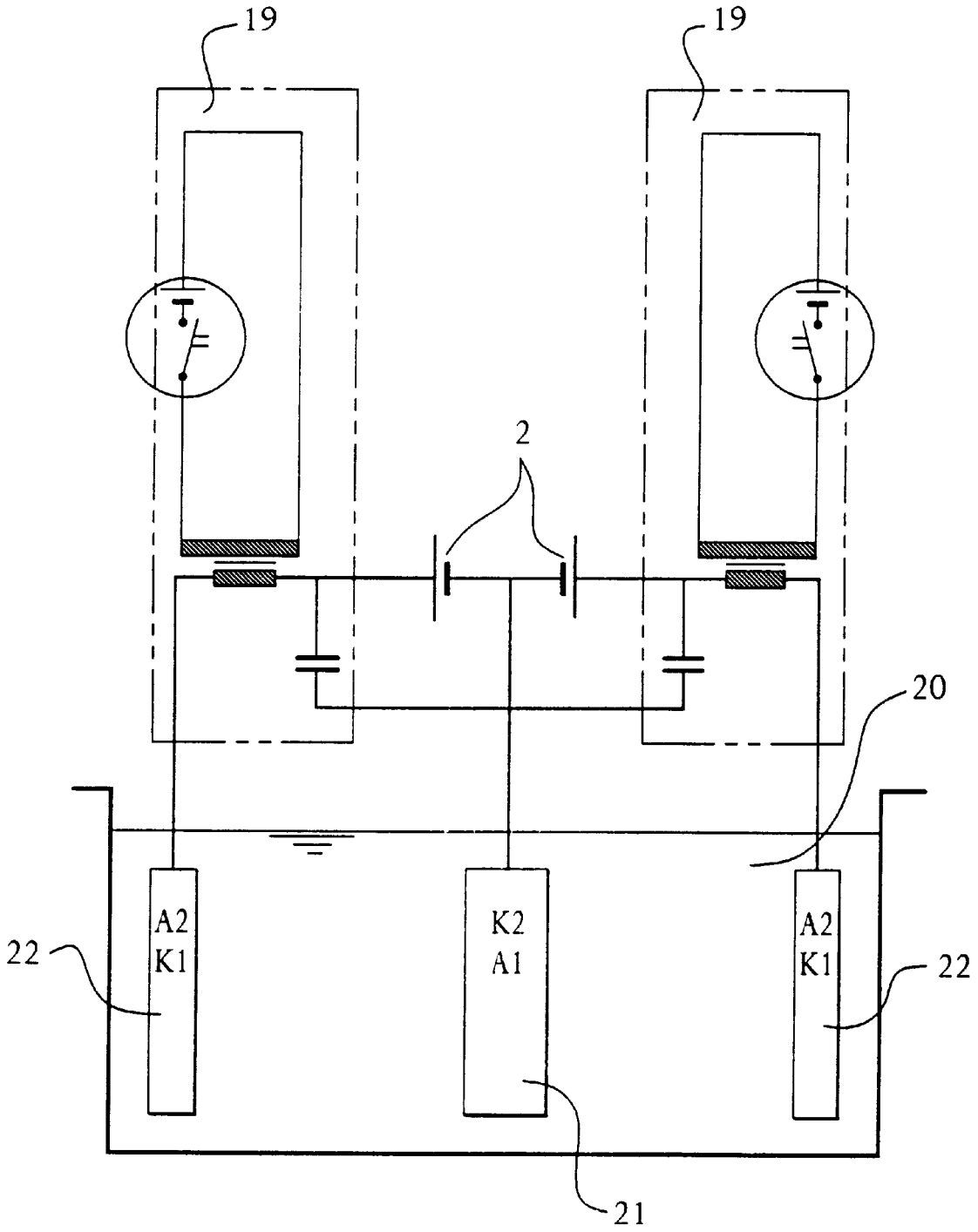
FIG. 6 an overall view of the circuit arrangement to be used for electroplating printed circuit boards.
Figure 7:
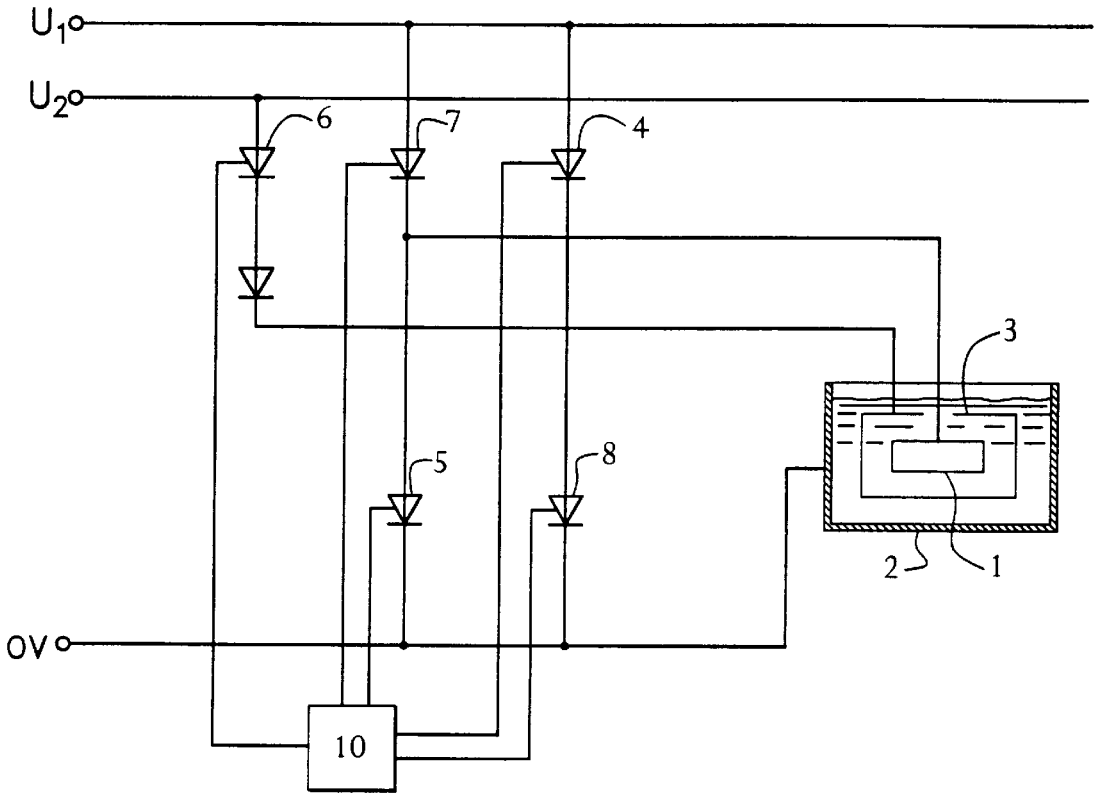
In FIG. 7 a traditional circuit arrangement, described in DE 40 05 346 A1, is shown.

FIG. 6 shows the application of the pulse current units 19 in an electroplating bath 20 with goods to be electroplated arranged vertically, for which bath two bath direct current sources 2 for the rear side and the front side of the flat article to be electroplated, for instance a printed circuit board, are used. Each side of the printed board 21 is separately supplied with electroplating current from one of these current sources 2. Opposite each side of the printed board an anode 22 is arranged. During the short deplating pulse, these anodes work as cathodes in relation to the article to be treated which is then poled anodically. Both pulse current units can work either in asynchronous or synchronous manner with one another. To electroplate the holes of printed boards, it is advantageous if the pulse sequences of the same frequency of both pulse current units are synchronised and if at the same time there is phase displacement of the pulses. The phase displacement must be such that, during the electroplating phase on the one printed board side, the deplating pulse occurs on the other side and the other way round. In this case, the dispersion of the metal, i.e. the electroplating of the holes, is improved. The pulse sequences of the same frequency can, however, where there is separate electrolytic treatment of the front and the rear side of the article to be treated, also run asynchronously towards one another.

The invention is suitable for all pulse electroplating methods. It can be used in electroplating systems, dipping systems and feed-through systems, working vertically or horizontally. In the feed-through systems, plate-shaped goods to be electroplated are held in a horizontal or vertical position during the treatment. The times and amplitudes mentioned in this specification can be altered within wide ranges in practical applications.

| Terms used in the specification | |
|---|---|
| $U_G$ | Electroplating voltage |
| $U_{GR}$ | Rectifier voltage |
| $U_C$ | Capacitor voltage |
| $U_{TP}$ | Primary transformer pulse voltage |
| $U_{TS}$ | Secondary transformer pulse voltage |
| $U_F$ | Forward voltage |
| $I_G$ | Electroplating current |
| $I_E$ | Deplating current |
| $I_K$ | Compensating current |
| $P_V$ | Power loss |
| ü | Current transformer reduction ratio |

| List of reference numbers | |
|---|---|
| 1 | Current transformer |
| 2 | Bath direct current source |
| 3 | Electrical conductors |
| 4 | Bath resistor $R_B$ |
| 5 | High current circuit |
| 6 | Secondary winding of the current transformer |
| 7 | Primary winding of the current transformer |
| 8 | Power pulse electronic unit |
| 9 | Mains supply |
| 10 | Capacitor with the capacity C |
| 11 | Choke |
| 12 | Auxiliary voltage source |
| 13 | Charging capacitor with the capacity $C_L$ |
| 14 | Electronic switch |
| 15 | Voltage pulses |
| 16 | Voltage diagram |
| 17 | Protective resistor |
| 18 | Current diagram |
| 19 | Pulse current unit |
| 20 | Electroplating cell |
| 21 | Goods to be treated |
| 22 | Anode |

What is claimed is:

1. Method for generating cyclically repeating, unipolar or bipolar pulse currents $I_G$, $I_E$ for electroplating, characterized in that there is coupled in an inductive manner into an electroplating direct current circuit (5), formed from a direct current source (2) and an electroplating cell (20) with a bath which exhibits resistance $R_B$, by means of a transformer (1) connected in series with the electroplating cell (20), a compensating pulse current $I_K$ of such polarity that the bath current supplied from the direct current source (2) is compensated or overcompensated to form the unipolar or bipolar pulse currents, there being a capacitor (10) connected in parallel to the direct current source (2) and in close spatial proximity to the electroplating cell (20).

2. Method according to claim 1 characterized in that the capacitor (10) is partially discharged during periods of time in which the bath current is not compensated or overcompensated.

3. Method according to claim 1, characterized in that, in order to generate unipolar current pulses, the amplitude of the compensating pulse current $I_K$ is set to be equal to or less than the amplitude of the bath current supplied from the direct current source (2).

4. Method according to claim 1, characterized in that, in order to generate bipolar current pulses, the amplitude of the compensating pulse current $I_K$ is set to be greater than the level of the bath current supplied from the direct current source (2).

5. Method according to claim 1, characterized in that pulse current for metallization $I_G$ and pulse current for deplating $I_E$ are applied and the amplitude of the pulse current for deplating $I_E$ is set to be higher than the amplitude of the pulse current for metallization $I_G$ and that the pulse width of the current $I_E$ is set to be shorter than the pulse width of the current $I_G$.

6. Method according to claim 1, characterized in that a separate electrolytic supply for each of the front side and rear side of an article being electroplated with pulse current is provided, and the same-frequency pulse sequences of the two sides are adjusted to be synchronous.

7. Method according to claim 6, characterized in that a constant phase displacement between the pulse currents on the front and rear side of the article being electroplated is set in such a way that deplating of said article does not occur on both sides at the same time.

8. Method according to claim 1, characterized in that a toroidal current transformer is used as the transformer (1) connected in series with the electroplating cell.

9. Circuit arrangement for electroplating with which cyclically repeating, unipolar or bipolar pulse current $I_G$, $I_E$ is generated, comprising an electroplating direct current circuit (5) formed from a direct current source (2) and an electroplating cell (20), means (8) for generating a pulse current, and a transformer (1) connected in series with the electroplating cell (20) for inductively coupling a compensating pulse current $I_K$ from the pulse current generating means (8) into the electroplating direct current circuit (5), wherein compensating pulse current $I_K$ is of such polarity that the bath current supplied from the direct current source (2) is compensated or overcompensated to form the unipolar or bipolar pulse currents, and further comprising a capacitor (10) connected in parallel to the direct current source (2) and in close spatial proximity to the electroplating cell (20).

10. Circuit arrangement according to claim 9 wherein transformer (1) has a primary winding (7) and a secondary winding (6), the secondary winding being connected in series with the direct current source (2) and the primary winding having a larger number of turns than the secondary winding.

* * * * *